US007759594B2

(12) United States Patent
Ishii et al.

(10) Patent No.: US 7,759,594 B2
(45) Date of Patent: Jul. 20, 2010

(54) THIN KEY SHEET AND PRODUCTION METHOD THEREOF

(75) Inventors: Hisashi Ishii, Niigata (JP); Minoru Yoshida, Niigata (JP)

(73) Assignee: Sunarrow Limited, Tokyo (JP)

( * ) Notice: Subject to any disclaimer, the term of this patent is extended or adjusted under 35 U.S.C. 154(b) by 201 days.

(21) Appl. No.: 11/997,952

(22) PCT Filed: Aug. 10, 2006

(86) PCT No.: PCT/JP2006/315792

§ 371 (c)(1),
(2), (4) Date: Feb. 5, 2008

(87) PCT Pub. No.: WO2007/018256

PCT Pub. Date: Feb. 15, 2007

(65) Prior Publication Data

US 2009/0229960 A1 Sep. 17, 2009

(30) Foreign Application Priority Data

Aug. 10, 2005 (JP) ..... 2005-231982

(51) Int. Cl.
*H01H 1/10* (2006.01)

(52) U.S. Cl. ..... 200/512; 200/517

(58) Field of Classification Search ..... 200/512–517, 200/341–345

See application file for complete search history.

(56) References Cited

U.S. PATENT DOCUMENTS 6,529,370 B1 * 3/2003 Kamishima ..... 361/679.08
2003/0213683 A1 * 11/2003 Shimizu et al. ..... 200/341
2006/0188946 A1 * 8/2006 Munekane et al. ..... 435/7.2

FOREIGN PATENT DOCUMENTS

JP 75005053 B * 2/1975

(Continued)

OTHER PUBLICATIONS

Written Opinion, PCT/IB/338 and PCT/IB/373 for PCT/JP2006/315792.

(Continued)

*Primary Examiner*—Renee S Luebke
*Assistant Examiner*—Lisa Klaus
(74) *Attorney, Agent, or Firm*—Westman, Champlin & Kelly, P.A.

(57) ABSTRACT

Preparing a resin film having a transparency and a thickness of 0.2 mm or less such as PC, PET, PU or the like; drawing the resin film in such a manner to form concave portions at positions corresponding to a plurality of the key tops of the resin film by pinching the resin film between heating drawing dies; forming a pressing element on the undersurface of the film by filling a filler (resin) into the concave portion formed by means of the drawing; and disposing the key tops by means of adhesion, the key tops formed on the top surface of the resin film by means of the resin formation, the mold printing or the like after the formation of the pressing elements, which achieves further thinner configuration of the key sheet with the configuration that the key tops and the pressing elements are disposed, respectively on the top surface and the undersurface of the resin film.

3 Claims, 7 Drawing Sheets

FOREIGN PATENT DOCUMENTS

| | | | |
|---|---|---|---|
| JP | 6-86238 | | 12/1994 |
| JP | 09-193193 | | 7/1997 |
| JP | 11224561 A | * | 8/1999 |
| JP | 2004-227867 | | 8/2004 |
| JP | 2005/166679 | | 6/2005 |

OTHER PUBLICATIONS

International Search Report and Written Opinion for PCT/JP2006/315792.

* cited by examiner

THIN KEY SHEET AND PRODUCTION METHOD THEREOF

CROSS-REFERENCE TO RELATED APPLICATION

This Application is a Section 371 National Stage Application of International Application No. PCT/JP2006/315792, filed Aug. 10, 2006, published as WO 2007/018256, not in English, the content of which is hereby incorporated by reference in its entirety

TECHNICAL FIELD

The present invention relates to a technology for thinning an entire key sheet on which a plurality of keys being input means for handy mobile equipment such as a portable phone, a personal digital assistant (PDA) or the like are collectively disposed.

BACKGROUND ART

A conventional key sheet was a component (subassembly) constituting a keyboard portion of handy mobile equipment such as a portable phone, a personal digital assistant (PDA) or the like, and such key sheet was configured so that a plurality of key tops which are push buttons indicating an alphabetical and/or numerical key or a functional key were arrayed and adhered onto the top surface of a sheet-shaped member referred to as a keypad. A material for the above-mentioned keypad was a soft sheet having rubber elasticity such as a silicone rubber or a thermoplastic elastomer or the like.

On the undersurface of the keypad thus configured, small projections referred to as pressing elements are attached to the area corresponding to each of the above-mentioned key tops, and furthermore the pressing elements are closely disposed to a printed circuit board formed independently which has a plurality of normal open contacts closed by pressing the push button, and according to those, a push button switch is formed.

Since the key sheet is thus configured in the manner that a plurality of components are piled up in layers, the thickness of each component is accumulated, which causes substantial total thickness of the key sheet. Therefore, it is required that whole of the handy mobile equipment should be thinned more so as to enhance the further portability thereof.

For example, the Patent References 1 and 2 set forth a production method of a key sheet using a method so called the mold printing where the key sheets is formed by transferring and pressure-bonding a resin filled in a plurality of convex portions provided on the surface of a rotating cylinder to a substrate sheet.

[Patent Reference 1]

Japanese Laid-Open Patent [Kokai] Publication No. H-11-156871

[Patent Reference 2]

Japanese Laid-Open Patent [Kokai] Publication No. 2003-127225

However, since a key sheet formed by the production methods set forth in the Patent References 1 and 2 has a configuration by means of a conventional layered structure formed by superposing key tops or the like as each individual part (component) on a keypad having rubber elasticity such as a silicone rubber, a thermoplastic elastomer or the like, there is a structural limitation for further thinner configuration. That is, there is a limitation for further thinner configuration of the keypad having rubber elasticity such as a silicone rubber, a thermoplastic elastomer or the like in the view of ensuring a click feeling and a strength when pressing a normal open contact. Therefore, it is not possible to thin a keypad to 0.2 mm or less, even if the pressing element portion which is the thickest portion is excluded.

Further, a method of integrally forming a projection such as a pressing element or a key top on a film made of a thin resin using the above-mentioned mold printing can be considered. In this case, if the key top is formed by means of the mold printing, the pressing element is necessary on the opposed undersurface side of the film. However, it is not possible, in the mold printing, to form projections on both surfaces of a single film. Therefore, when forming the key tops and the pressing elements together by means of the mold printing, it is necessary, for example, to adhere together a film having the pressing elements provided on its one side by means of the mold printing and a film having the key tops provided on its one side by the mold printing.

In addition, a key top formed by means of the mold printing is not good in its operational feeling, since the key top is, in many cases, made of relatively soft materials such as PVC, acrylic UV-cured resins or the like.

Further, a method of forming key tops on one side of the sheet by means of the mold printing and forming pressing elements only by dropping a resin onto the back surface of the film using a dispenser or the like can also be considered. However, it is quite difficult to control precisely an amount of the resin to be dropped, since the pressing elements become very small only by the simple dropping method. That is, this method involves a problem in which the size of a pressing element is affected by an amount of the resin to be dropped.

DISCLOSURE OF THE INVENTION

The present invention aims to overcome the above-mentioned various problems and to reduce the thickness of handy mobile equipment as much as possible so as to further improve the portability thereof.

In order to achieve the above-mentioned aim, on the condition that a combination of a key pad and a key top made of a silicone rubber or thermoplastic elastomer, which has a limitation for thinner configuration is not employed, one embodiment of the present invention employs a method of adopting a single sheet of a resin film as a material for constituting a base portion of a key sheet and forming pressing elements on the undersurface thereof, and forming key tops on the top surface being the opposite side of the same resin film, so that a key sheet is formed in which the key tops and the pressing elements are integrally formed on the top surface and the undersurface thereof so as to have thinned configuration.

DETAILED DESCRIPTION OF THE INVENTION

Hereinafter, embodiments and examples of the present invention are described in detail with reference to the drawings.

Figure 1:
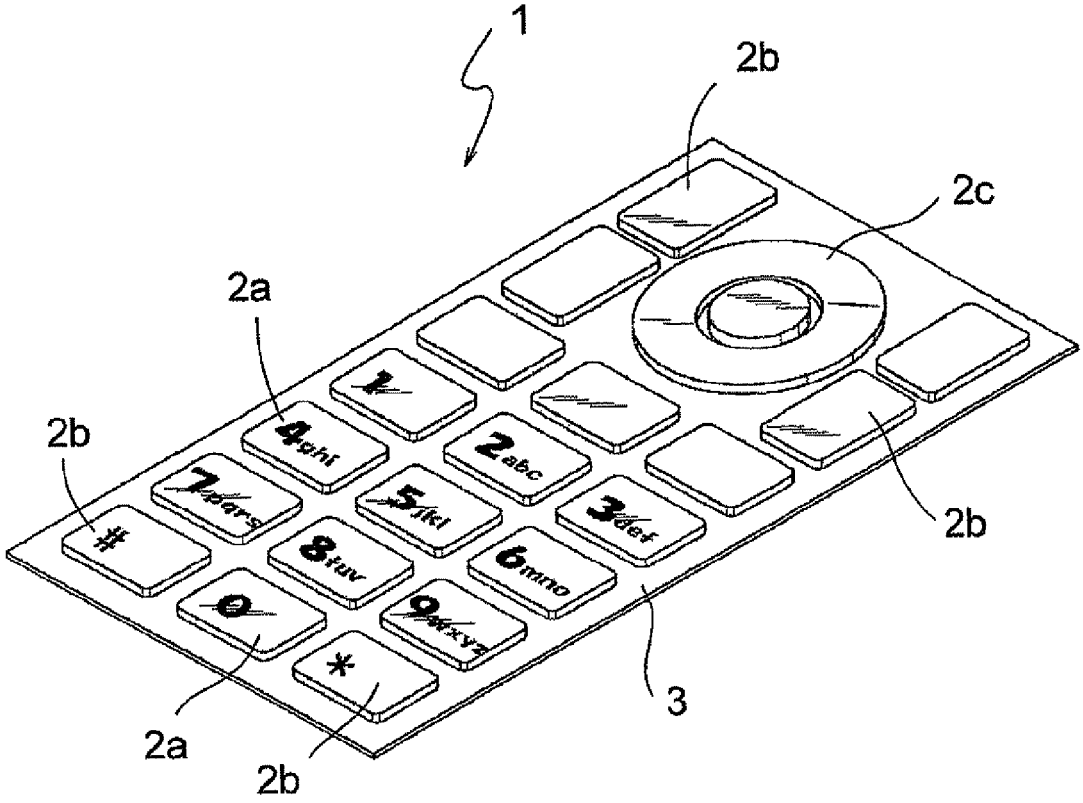
FIG. 1 is an enlarged perspective view of a key sheet of the present invention.
Figure 2:
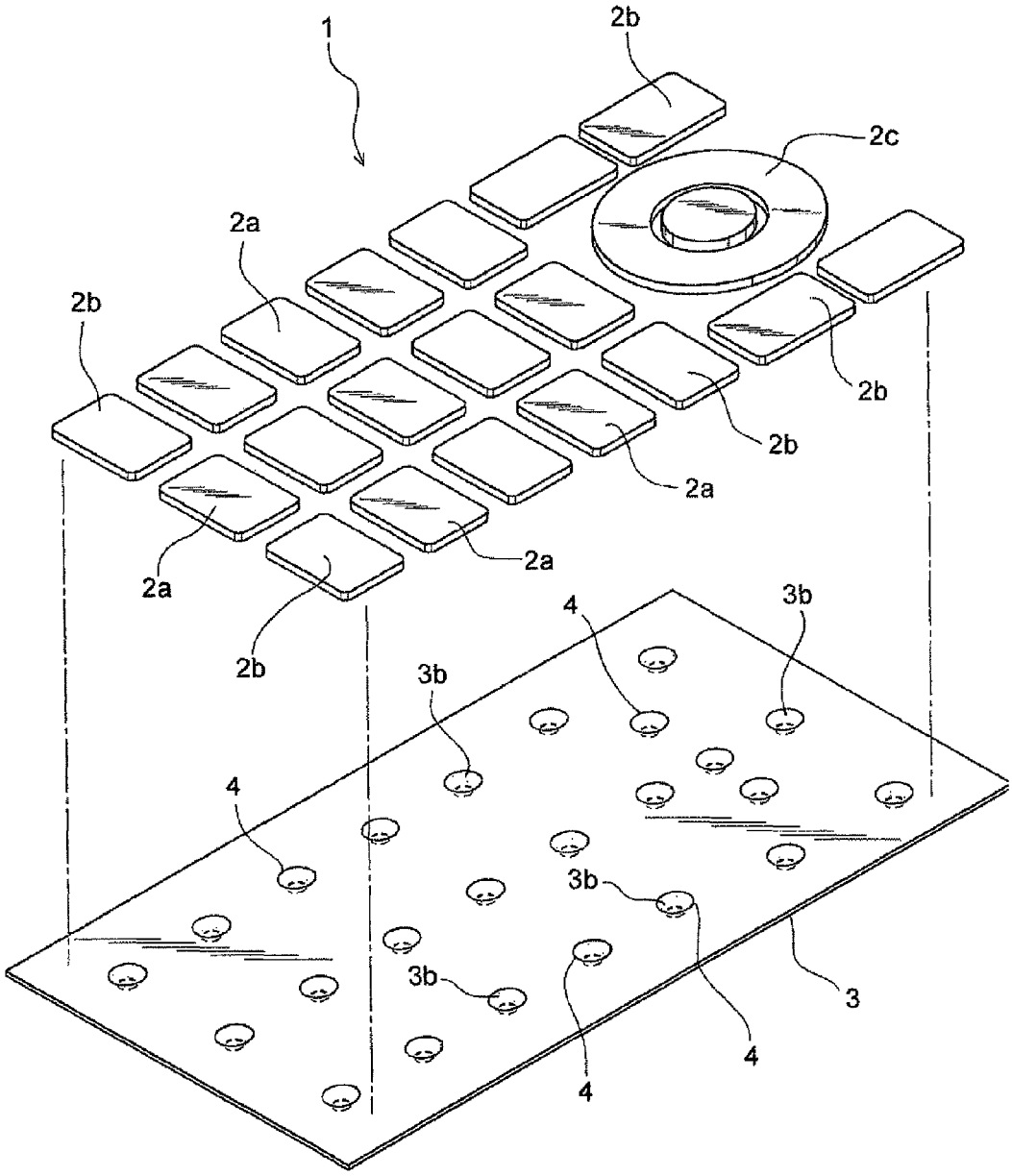
FIG. 2 is an enlarged perspective view showing, in an exploded manner, one embodiment of a key sheet of the present invention.

FIG. 1 is an enlarged perspective view of an embodiment of a thin key sheet of the present invention, and FIG. 2 is an enlarged perspective view showing the key sheet in an exploded manner. A key sheet 1 of this embodiment is obtained by preparing a resin film 3 having a transparency such as a thin polycarbonate resin (hereinafter referred to as "PC"), a polyethylene terephthalate resin (hereinafter referred to as "PET"), a polyurethane resin (hereinafter referred to as "PU") or the like, and attaching a plurality of key tops onto the top surface thereof in a predetermined array. The thickness of the resin film 3 is considered to be, for example, 0.5 mm or less, preferably 0.2 mm or less, and more preferably 0.1 mm or less. Further, the resin film having a transparency includes any resin films as long as they can allow a light permeating, and also includes colored ones, ones having patterns or the like.

Figure 3:
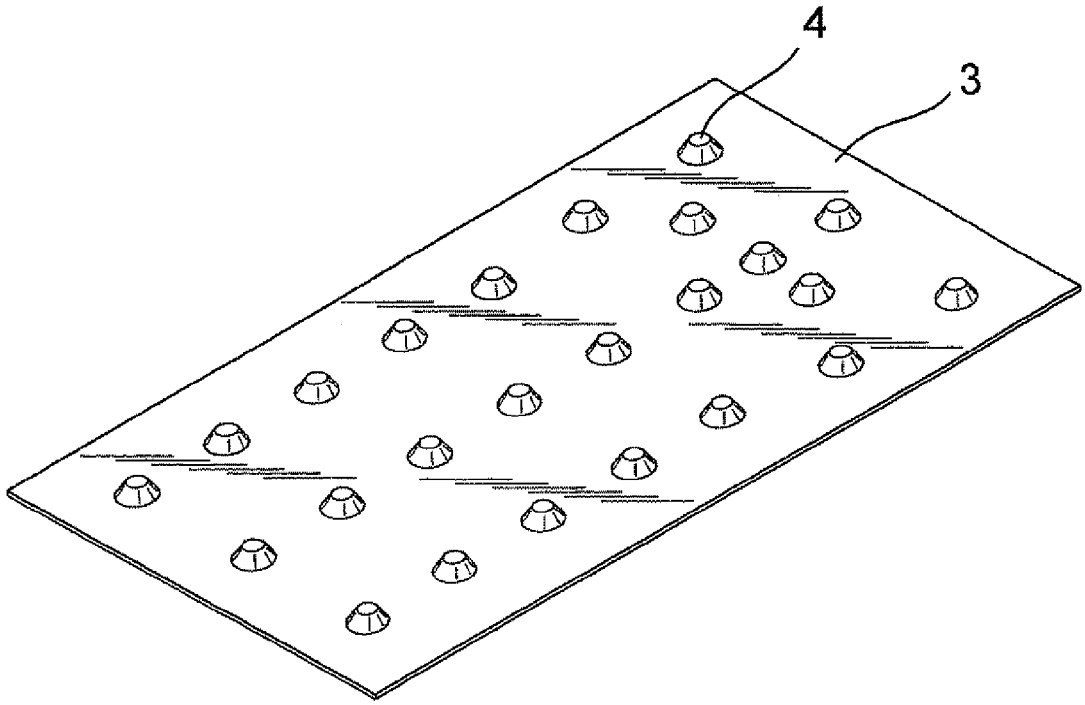
FIG. 3 is an enlarged perspective view of a resin sheet seen from the back side, so as to show a plurality of pressing elements configured on the undersurface of the resin sheet constituting a base portion of a key sheet of the present invention.
Figure 4:
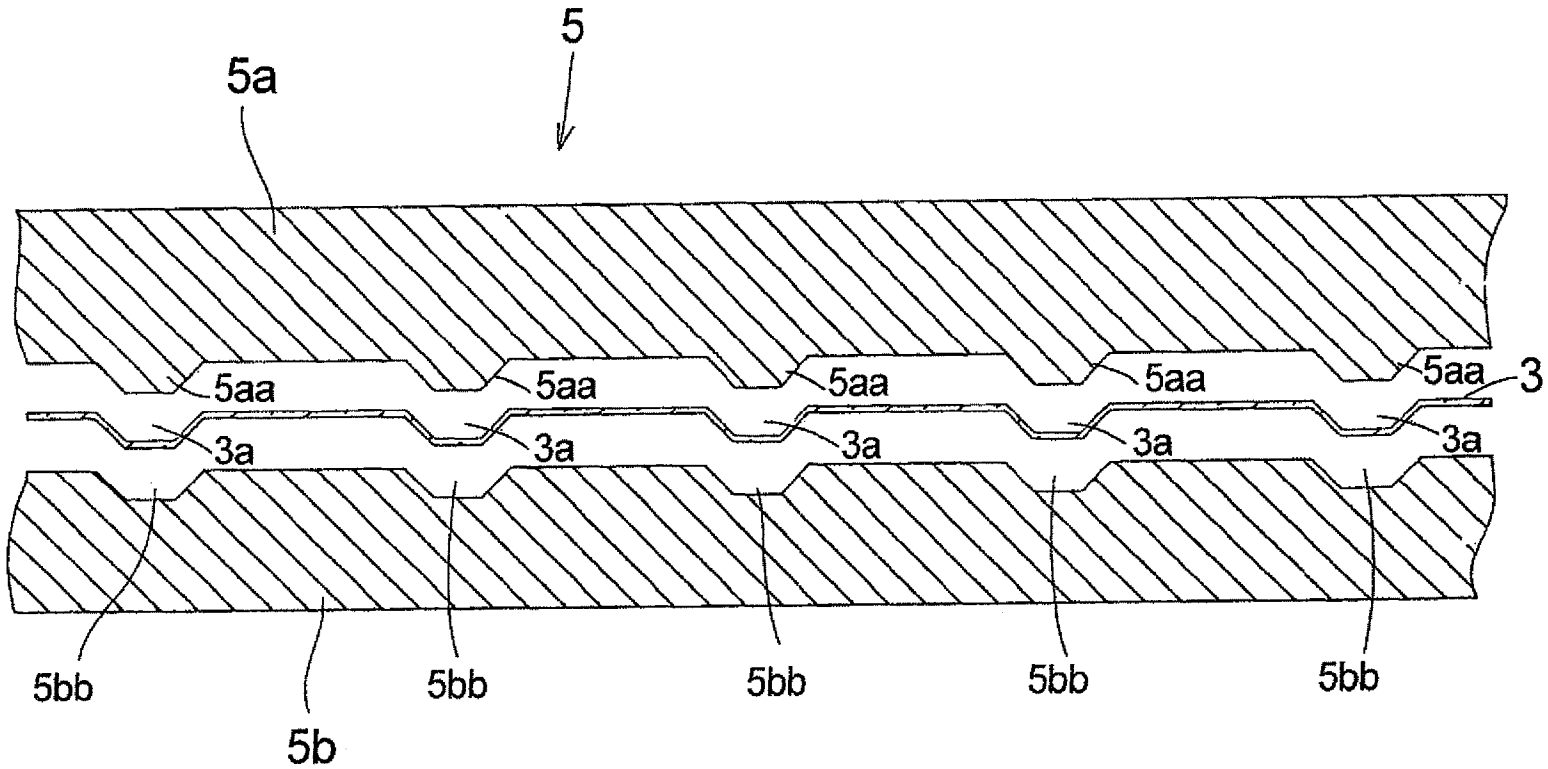
FIG. 4 is an enlarged longitudinal sectional view showing a male die and a female die of a drawing die for forming pressing elements according to the present invention on a resin film, and a resin film provided with pressing elements shown between the male die and the female die.

A method of attaching a key top may be any methods including adhesion. And the key sheet is completed by forming pressing elements on the undersurface of the same resin film 3. As an example of a means for forming a plurality of pressing elements 4 in a projecting manner as shown in FIG. 3, a drawing die 5 shown in FIG. 4 is prepared. The drawing die 5 is a hot forming means composed of a male die 5*a* and a female die 5*b*. For the resin film 3, those having a multilayered structure can be used, in which a plurality of extremely-thin films composed of resin materials having different thickness or of different materials are layered, for example by adhering together as long as they have a transparency, as well as those composed of a single material such as the above-mentioned PC, PET, PU or the like.

On the male die 5*a*, a plurality of projections 5*aa* are provided in a projecting manner at positions corresponding to appropriate positions on the back side of a plurality of key tops 2*a*, 2*b* and 2*c* or the like as shown in FIGS. 1 and 2, and the projections 5*aa* have a size capable of giving a desired length, width and height. On the female die 5*b*, a plurality of concave portions 5*bb* which are adapted to receive a plurality of the projections 5*aa* respectively are provided in a concave manner. As one example of the projection 5*aa*, a projection of a truncated cone shape having a width of around 2 mm and a height of about 0.2 mm is illustrated. However, there is no need of being limited to this shape, and a projection of a pointed pyramid shape or a round-head column shape may be adopted.

Figure 5:
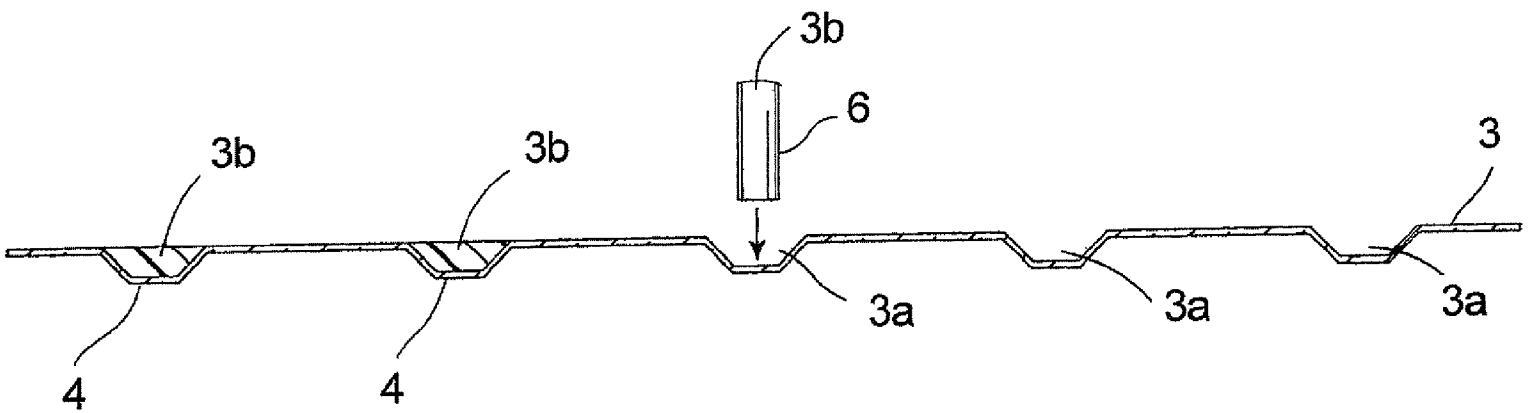
FIG. 5 is an enlarged longitudinal sectional view showing a step of filling a hard resin material into concave portions formed on a resin film by the drawing as shown in FIG. 4 using, for example, a dispenser (nozzle).

The resin film 3 with a concave portions 3*a* as illustrated in FIG. 4 can be obtained by pressing the male die 5*a* and the female die 5*b* of the drawing die 5 after inserting the above-mentioned resin film 3 between them, and then pressing the male die 5*a* and the female die 5*b* while heating in the condition to pinch the resin film 3. Subsequently, a pressing element 4 is accomplished (see FIG. 5) by filling resin into the concave portion 3*a* using a dispenser 6.

Figure 6:
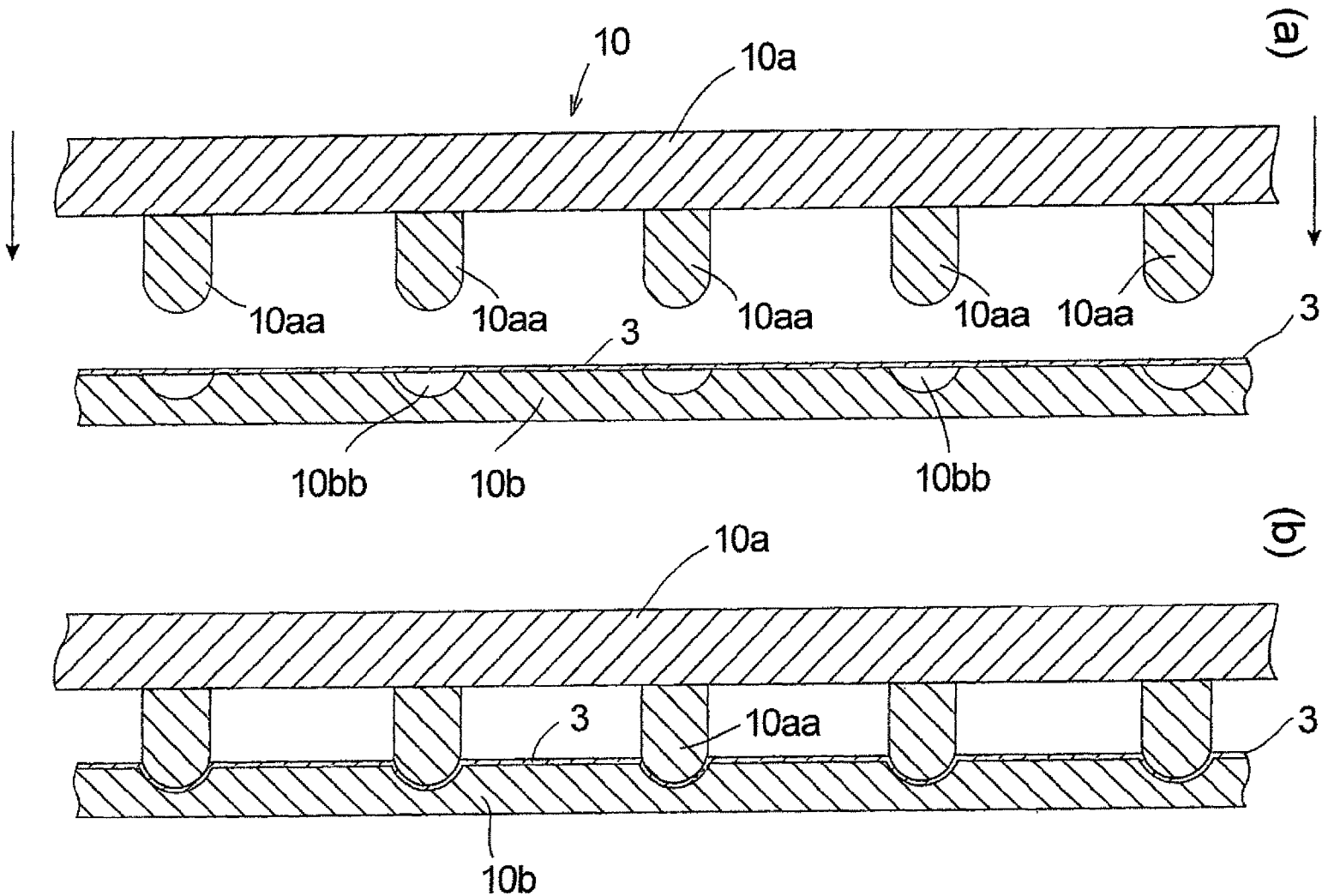
FIGS. 6(*a*) and (*b*) are enlarged longitudinal sectional views showing an alternative plan for a drawing die and a using method thereof.

A draw mold 10 for forming a pressing element of the above-mentioned round-head column shape is illustrated in FIG. 6. That is, a male dies 10*a* on which a plurality of projections 10*aa* of round-head column shape having a size capable of giving a desired length, width and height are provided in a projecting manner, and a female die lob on which a plurality of concave portions 10*bb* adapted to receive a plurality of projections 10*aa* respectively for cooperating therewith are provided in a concave manner are provided.

Figure 7:
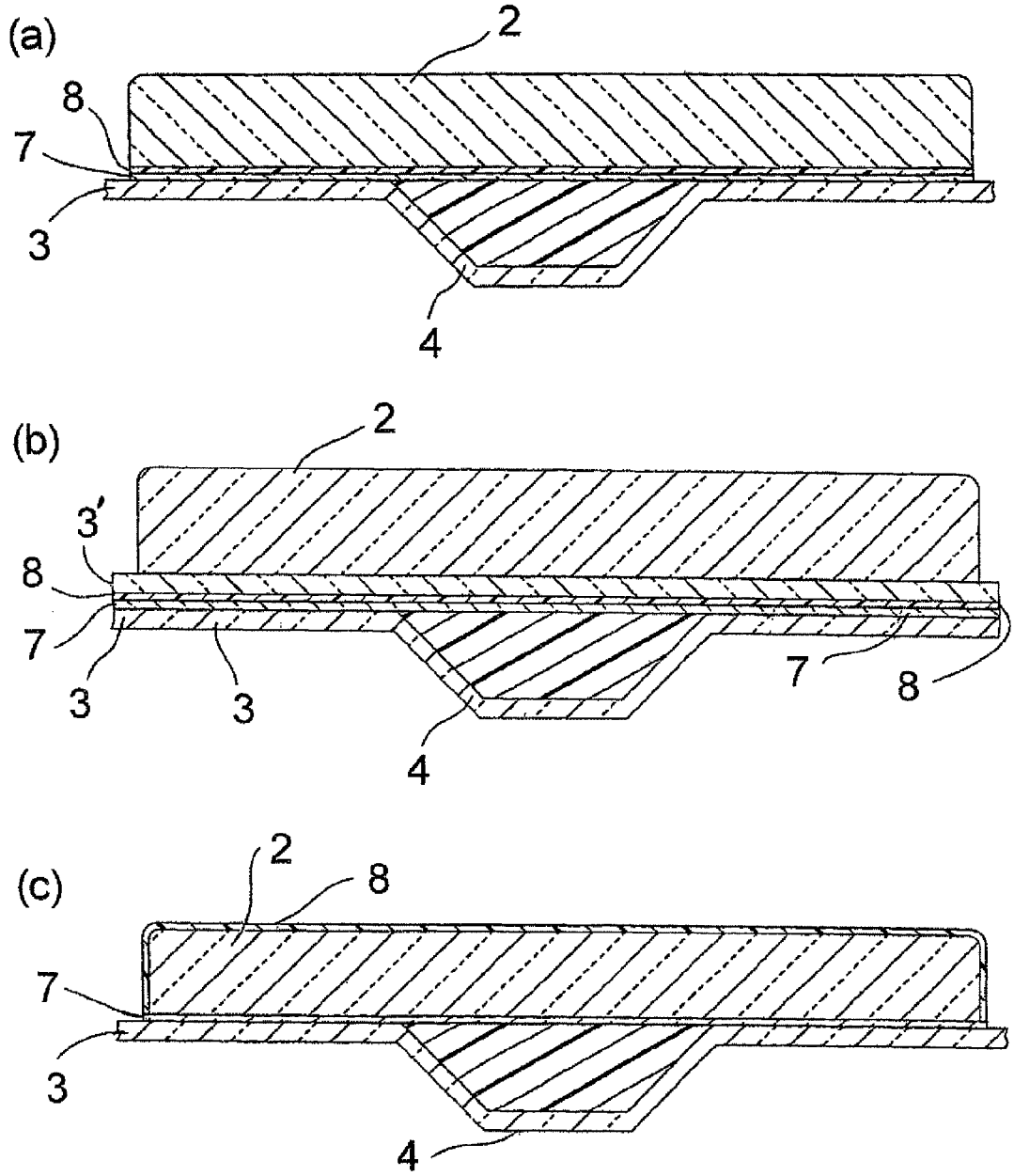
FIGS. 7(*a*), (*b*) and (*c*) are enlarged longitudinal sectional views illustrating three embodiments of attaching a key top to the upper side of the resin sheet provided with a pressing element according to the present invention.

A resin film 3 with a concave portion for forming a pressing element as illustrated in FIG. 7 can be obtained by pressing the male die 10*a* and the female die lob of the drawing die 10 after inserting the resin film 3 between them, and then pressing the male die 10*a* and the female die lob while heating in the condition to pinch the resin film 3. In this case, heating of the resin film 3 is not necessarily required. The concave portion 10*bb* may be formed partially by pressing the resin film 3 to deform it by pressing the projection 10*aa* to the resin film 3.

A pressing element 4 is a trans-missive element for transmitting the movement of the key top to a normal open contact having a metal dome or the like on a printed circuit board positioned at the underneath thereof so as to change it into the closed state, when a key top is pushed. In order to achieve such trans-missive function, a resin 3*b* composed of a material which is in a liquid form in the initial state and can be subsequently cured such as, for example, various adhesives, UV-cured resins and thermosetting resins is injected or filled into the concave portion 3*a* using the dispenser 6. A relatively hard film on the surface of the pressing element and the material 3*b* injected or filled at this time become a decisive factor to give a better click feeling.

The following can be exemplified for the thermosetting resin; phenol resin, furan resin, xylene formaldehyde resin, ketone formaldehyde resin, urea resin, melamine resin, aniline resin, alkyd resin, unsaturated polyester resin, epoxy resin or the like.

In the next place, an explanation will be given for a step for providing a key top 2 on the surface of a resin film 3 having the back surface on which a pressing element 4 is formed. In each enlarged longitudinal sectional view in FIG. 7, the undermost layer is the layer of a resin film 3 provided with a pressing element 4 formed according to the above-mentioned step. On top of this layer, a key top 2 is attached through an adhesive layer 7.

FIG. 7(*a*) shows an example 1 for attaching a key top. Regarding the key top 2, a plurality of key tops 2*a*, 2*b*, 2*c* or the like having various indications are attached onto the respective predetermined positions and lined alongside on the sheet. In this illustration, however, the enlarged partial sectional view of FIG. 7(*a*) shows only one key top portion in a separate manner. The layer underneath the key top 2 is a decorative layer 8.

The decorative layer is a layer for giving ornamentation, as well as indication of a ten-key 2*a*, a function key 2*b*, a cursor key 2*c*, or the like which should be indicated by each key top, and includes, for example, a positive form in which the shapes of letters, symbols or the like are formed directly by means of printing and so on, or a what is called drawn-letter (negative) form in which the peripheral parts of letters, symbols or the like which are the parts other than the shapes of the letters, symbols or the like are formed by means of printing and so on. The key top 2 having the decorative layer 8 at the underneath thereof is individually adhered onto the resin film 3 provided with a pressing element 4 through the adhesive layer 7, so that a thin key sheet is accomplished.

FIG. 7(*b*) shows an example 2 for attaching a key top. The key top 2 is provided with a first resin film 3 having the undersurface on which a plurality of pressing elements 4 with resin being filled therein are formed in a projecting manner by means of the heating drawing and a second resin film 3' having the top surface on which a plurality of key tops 2*a*, 2*b*, 2C, or the like having various indications are disposed at the respective predetermined positions by means of the mold printing. And the top face of the first resin film 3 and the undersurface of the second resin film 3' are superposed together, so that the whole films are configured in a sheet shape. In this illustration, however, the enlarged partial sectional view of FIG. 7(*b*) shows only one key top portion in a cutoff manner. Further, there exists a decorative layer 8 on the undersurface of the second resin film 3'. The decorative layer 8 and the layer of the first resin film 3 provided with a pressing element 4 are adhered in a superposed manner through the adhesive layer 7, so that the thin key sheet of the present invention is accomplished.

For the material of the second resin film 3', a resin film having a transparency such as PC, PET, PU or the like can be used in the same manner as the first resin film 3. Further, the thickness of the second resin film 3' is considered to be, for example, 0.5 mm or less, preferably 0.2 mm or less, and more preferably 0.1 mm or less, in the same manner as the first resin film 3. The same material and the same thickness can be adopted for both the first resin film 3 and the second resin film 3', and different materials and different thicknesses can also be adopted for each of them.

FIG. 7(*c*) shows an example 3 for attaching a key top. In this example, the decoration of the key top 2 exists on the top face instead of the undersurface of the key top 2 as a decorative layer 8. Since the decorative layer 8 is exposed to the outer surface, a coating (overcoat) may be applied thereon for the protection.

Only an adhesive layer 7 is interposed between the layer of the resin film 3 provided with a pressing element 4 and the key top 2.

INDUSTRIAL APPLICABILITY

Since the present invention relates to a thin key sheet for use in mobile equipment such as a portable phone, and a personal digital assistants (PDA), it has a wide range of applicability in industrial fields seeking for a thinner configuration of the equipment provided with keys, including manufacturing industries of electronic equipment and the various components thereof.

EFFECT OF THE INVENTION

1) Since a key pad made of a material having rubber elasticity such as a silicone rubber or a thermoplastic elastomer or the like is not used, thinner configuration of the entire key sheet can be achieved.
2) It is possible to make the shape of a pressing element uniform with no unevenness, without being affected by an amount of resin to be supplied, so that the productivity can be improved.
3) Since the surface of a pressing element is a relatively hard film, a better click feeling can be obtained, and a resin filled into the interior of the pressing element allows further better click feeling, which adapts to the needs of users regarding a portable phones or the like.

DESCRIPTION OF SYMBOLS

1: Key sheet
2: Key top
2*a*: Ten-key
2*b*: Function key
2*c*: Cursor key
3: Resin sheet
3*b*: Filler
4: Pressing element
5: Drawing die
5*a*: Male die
5*b*: Female die
5*aa*: Projection
5*bb*: Concave portion
6: Dispenser
7: Adhesive
8: Decoration
10: Alternative to drawing die
10*a*: Male die
10*b*: Female die
10*aa*: Projection
10*bb*: Concave portion

The invention claimed is:

1. A thin key sheet comprising;

a first resin film constituting a base portion of a key sheet and having a transparency and a thickness of 0.1 mm or less, a plurality of pressing elements having bulges formed at a predetermined position on an undersurface of said first resin film, in a projecting manner by means of a heating drawing, with a resin filled in said bulges, a second resin film constituting a base portion of a key sheet and having a transparency and a thickness of 0.1 mm or less, and a plurality of key top portions formed by means of a mold printing on a top surface of said second resin film and at a position corresponding to each of said plurality of pressing elements, wherein the key sheet is configured by superposing and adhering a top surface of said first resin film and an undersurface of said second resin film together.

2. The thin key sheet according to claim 1, wherein at least one of the first and second resin films is made of a resin having a transparency and a monolayer structure composed of a single material including a polycarbonate resin, a polyethylene terephthalate resin or a polyurethane resin.

3. The thin key sheet according to claim 1, wherein at least one of said first and second resin films has a transparency and a multilayered structure in which a plurality of films made of resin materials having different thickness or of different materials are layered.

* * * * *